US012778278B2

(12) United States Patent
Chen

(10) Patent No.: US 12,778,278 B2
(45) Date of Patent: Nov. 3, 2026

(54) EASY-TO-TRANSPORT TABLE

(71) Applicant: SOPHIA & WILLIAM BRANDS CO. LTD, Nanjing (CN)

(72) Inventor: Meidi Chen, Nanjing (CN)

(73) Assignee: SOPHIA & WILLIAM BRANDS CO. LTD, Nanjing (CN)

( * ) Notice: Subject to any disclaimer, the term of this patent is extended or adjusted under 35 U.S.C. 154(b) by 62 days.

(21) Appl. No.: 18/822,122

(22) Filed: Aug. 31, 2024

(65) Prior Publication Data

US 2026/0060413 A1 Mar. 5, 2026

(51) Int. Cl.
*A47B 3/06* (2006.01)
*A47B 13/08* (2006.01)

(52) U.S. Cl.
CPC ..... *A47B 3/06* (2013.01); *A47B 13/083* (2013.01); *A47B 13/088* (2013.01)

(58) Field of Classification Search
CPC ..... A47B 3/06; A47B 13/083; A47B 13/088
See application file for complete search history.

(56) References Cited

U.S. PATENT DOCUMENTS 6,553,921 B2 * 4/2003 Liu ..... A47B 13/06 108/157.15
6,877,443 B2 * 4/2005 Rivera ..... A47B 13/003 108/157.15
7,296,522 B1 * 11/2007 Mahmalji ..... A47B 37/04 108/50.13
8,387,544 B1 * 3/2013 Lee ..... A47B 13/08 108/90
8,418,633 B1 * 4/2013 Lee ..... A47B 13/003 108/157.15
8,522,696 B1 * 9/2013 Lee ..... A47B 13/08 108/27
11,324,308 B2 * 5/2022 Lai ..... F16B 12/44
D1,024,635 S * 4/2024 Chen ..... D6/691.1
2012/0079967 A1 * 4/2012 Palese ..... A47B 1/08 108/71
2016/0296004 A1 * 10/2016 Peng ..... A47B 3/002
2025/0143450 A1 * 5/2025 Chen ..... A47B 13/003
2025/0176705 A1 * 6/2025 Chen ..... A47B 37/04
(Continued)

FOREIGN PATENT DOCUMENTS

CN 2379021 Y * 5/2000
CN 210203803 U 3/2020
CN 210988812 U 7/2020
(Continued)

*Primary Examiner* — Hanh V Tran
(74) *Attorney, Agent, or Firm* — Nitin Kaushik

(57) ABSTRACT

The present invention relates to the technical field of tableware, and in particular, to an easy-to-transport table. The table includes a table top, where four corners of a bottom surface of the table top are in bolted connection with the table legs, an enclosed area of inner sides of the table legs is in bolted connection with the rectangular support frame, a long-edge frame of a body of the support frame is vertically provided with a support rod, and the top of the support rod is in bolted connection with the bottom of the table top for improving stability of the table, so that the problems that an existing table is large in transportation occupied space, high in transportation cost, poor in stability and the like are resolved.

8 Claims, 19 Drawing Sheets

(56) References Cited

U.S. PATENT DOCUMENTS

2025/0380796 A1* 12/2025 Chen ..... A47B 13/02

FOREIGN PATENT DOCUMENTS

| | | | | | |
|---|---|---|---|---|---|
| CN | 216494067 | U | | 5/2022 | |
| CN | 217851817 | U | * | 11/2022 | ..... A47B 3/06 |
| CN | 221599446 | U | * | 8/2024 | ..... A47B 3/06 |
| TW | M536888 | U | * | 2/2017 | |

* cited by examiner

EASY-TO-TRANSPORT TABLE

TECHNICAL FIELD

The present invention relates to the technical field of tableware, and in particular, to an easy-to-transport table.

BACKGROUND

The table is a common piece of furniture, and is usually composed of a table top and four table legs, and is used for supporting items or serving as a working or dining surface. Table legs and table top of the common table are fixed, and the table legs are fixed to the table top. The fixed design greatly occupies the transportation space, has a high transportation cost, and is inconvenient to assemble and disassemble; and therefore, the table is not easy to package during transportation and is inconvenient to transport.

At present, there are many foldable tables on the market. Since some parts adopt a welding manner and are limited in transportation, the overall load performance is low, the stability is poor, and the requirement of a user for the use effect of the table is not met.

Therefore, the present applicant provides an easy-to-transport table, for solving the problems raised in the above background.

SUMMARY

The present invention aims to provide an easy-to-transport table, which solves the problems that an existing table is large in transportation occupied space, high in transportation cost, poor in stability and the like.

To resolve the foregoing technical problem, the present invention provides an easy-to-transport table, including a table top, where four corners of a bottom surface of the table top are in bolted connection with table legs, an enclosed area of inner sides of the table legs is in bolted connection with a rectangular support frame, a long-edge frame of a body of the support frame is vertically provided with a support rod, and the top of the support rod is in bolted connection with the bottom of the table top for improving stability of the table.

The technical solution of the present invention has the following improvement: a body of the table top is formed by splicing a first table top and a second table top having the same shape, the first table top includes a first table plate arranged in a first frame, the second table top includes a second table plate arranged in a second frame, a penetrating mounting hole A is arranged at a joint of the first frame and the second frame, and a bolt is arranged in the mounting hole A for splicing and fixing the first frame and the second frame.

The technical solution of the present invention has the following improvement: each side surface of inner sides of the first frame and the second frame is provided with a square fixed strip in an abutting manner, inner side areas of the first frame and the second frame are each provided with a transverse support member in the abutting manner, and the support members are uniformly distributed at intervals in the inner side areas of the first frame and the second frame.

The technical solution of the present invention has the following improvement: a horizontal penetrating mounting hole B is arranged on the square fixed strip, and a bolt is arranged in the mounting hole B to be in threaded connection with the first frame; two mounting holes C are arranged at both ends of each support member, and a bolt is arranged in each mounting hole C to be in threaded connection with the first frame.

The technical solution of the present invention has the following improvement: four corners of the support frame are in bolted connection with the table legs, and the support frame is formed by splicing two U-shaped members with openings opposite to each other.

The technical solution of the present invention has the following improvement: an outer side of the long-edge frame of the body of the support frame is in threaded connection with a side surface of one end of the support rod, and a top surface of the other end of the support rod is respectively connected to bottom surfaces of the first frame and the second frame through two bolts.

The technical solution of the present invention has the following improvement: a bracket is mounted in the support frame, connecting members are arranged at two ends of the bracket, the connecting members are clamped to the support frame, and an umbrella rod fixed square hole B is arranged in the middle of the bracket for fixing a sunshade.

The technical solution of the present invention has the following improvement: two threaded holes A arranged up and down are arranged at a side surface of each connecting member, bolts in the threaded holes A sequentially penetrate through the connecting members and the support frame to be in threaded connection with the support rod; two threaded holes B are arranged at the top of each connecting member, two threaded holes C are arranged at the bottom of each connecting member, and bolts in the threaded holes B and the threaded holes C are connected to the support frame.

The technical solution of the present invention has the following improvement: the center of a joint of the first frame and the second frame is provided with an umbrella rod fixed circular hole A, centers of the umbrella rod fixed circular hole A and the umbrella rod fixed square hole B are aligned for jointly fixing the sunshade, and a cover body is arranged on the umbrella rod fixed circular hole A.

The technical solution of the present invention has the following improvement: the table top is an integral body, a body of the table top includes a table plate, and an outer frame is arranged on the periphery of the table plate.

The present invention has the following beneficial effects after adopting the above-mentioned technical solution.

1. According to the easy-to-transport table provided by the present invention, the table top of the table is formed by detachably splicing a first table top and a second table top. A structure which is in bolted connection and facilitates disassembly and assembly is arranged between the table top and the table legs, the table legs and the support frame, and the support frame and the support rod, respectively. Each part is disassembled and then packaged and transported, thereby greatly reducing the transportation space and saving the transportation cost.

2. According to the easy-to-transport table provided by the present invention, the table top of the table is an integral body. A structure which is in bolted connection and facilitates disassembly and assembly is arranged between the table top and the table legs, the table legs and the support frame, and the support frame and the support rod, respectively. Each part is disassembled and then packaged and transported, thereby greatly reducing the transportation space and saving the transportation cost.

3. According to the easy-to-transport table provided by the present invention, an enclosed area of inner sides of the table legs is provided with a support frame, a long-edge frame of a body of the support frame is vertically provided with a support rod, and the top of the support rod is in bolted connection with the bottom of the table top, so that the stability of the table is better.

4. According to an easy-to-transport table provided by the present invention, an umbrella rod fixed circular hole A is arranged on the table top, and an umbrella rod fixed square hole B is arranged on the bracket for placing a sunshade umbrella rod, facilitating a user to place a sunshade for shading when using the table outdoors, which increases practicability of the table, and the two holes on the top and bottom further enhance the stability of the sunshade.

BRIEF DESCRIPTION OF THE DRAWINGS

To describe the technical solutions in the specific embodiments of the present invention or in the prior art more clearly, the following briefly describes the accompanying drawings needed for describing the specific embodiments or the prior art. Apparently, the accompanying drawings in the following description show some embodiments of the present invention, and those of ordinary skill in the art may further derive other accompanying drawings from these accompanying drawings without creative labor.

Figure 1:
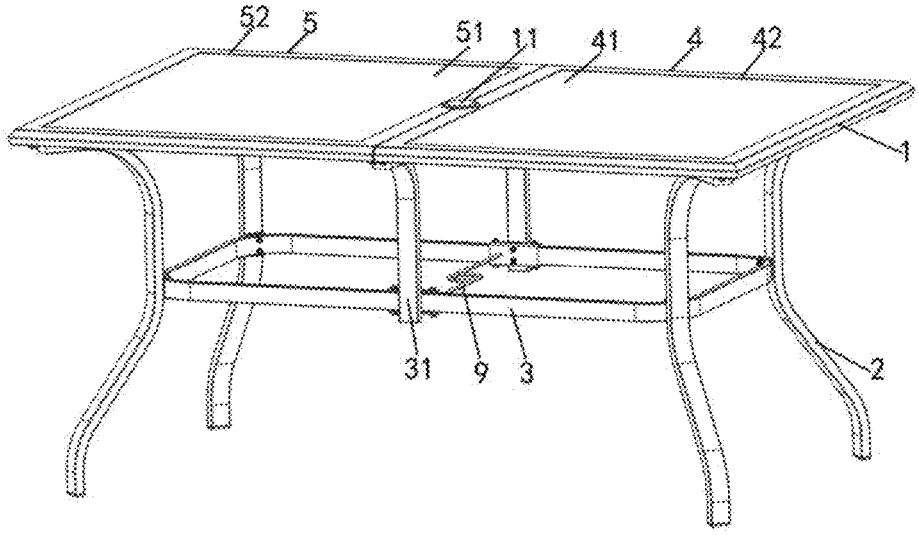
FIG. 1 is an overall schematic diagram of an easy-to-transport table.

Reference numerals in the drawings: 1. table top; 2. table leg; 3. support frame; 4. first table top; 5. second table top; 6. mounting hole A; 61. bolt (in mounting hole A); 7. square fixed strip; 8. support member; 9. bracket; 10. umbrella rod fixed circular hole A; 11. cover body; 31. support rod; 41. first table plate; 42. first frame; 51. second table plate; 52. second frame; 71. mounting hole B; 72. bolt (in mounting hole B); 81. mounting hole C; 82. bolt (in mounting hole C); 91. umbrella rod fixed square hole B; 92. connecting member; 93. threaded hole A; 94. threaded hole B; 95. threaded hole C.

DETAILED DESCRIPTION OF THE EMBODIMENTS

An explicit and complete description of the technical solution in the present invention is given below in conjunction with the accompanying drawings. Apparently, the described embodiments are part not all of the embodiments of the present invention. Based on the embodiments in the present invention, all other embodiments obtained by those of ordinary skill in the art without making creative labor fall within the scope of protection of the present invention.

In the description of the present invention, it should be noted that, the orientations or positional relationships indicated by the terms "center", "up", "down", "left", "right", "vertical", "horizontal", "inside", "outside", etc. are based on those shown in the accompanying drawings, intended only for the convenience of describing the present invention and for simplifying the description, and not intended to indicate or imply that the referred apparatus or element must be provided with a particular orientation or constructed and operated with a particular orientation, therefore not allowed to be construed as a limitation of the present invention. Furthermore, the terms "first", "second", "third" are used for descriptive purposes only and not allowed to be construed as indication or implication of relative importance.

In the description of the present invention, it should be noted that, unless otherwise explicitly provided and limited, the terms "mounted", "attached", "connected" should be understood in a broad sense, e.g., it may be a fixed connection, a detachable connection or an integral connection; it may be a mechanical connection or an electrical connection; it may be a direct attachment, or an indirect attachment through an intermediate medium; and it may be a communication within two elements. For those of ordinary skill in the art, the specific meaning of the above-mentioned terms in the present invention can be construed according to specific cases.

The present invention is further explained and illustrated below in conjunction with specific embodiments.

Embodiment 1

Figure 2:
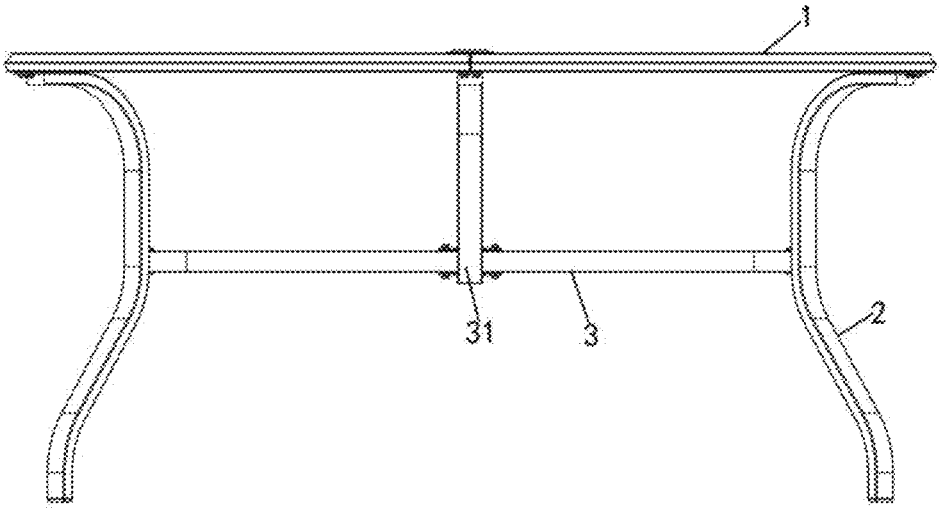
FIG. 2 is a front view of an easy-to-transport table.
Figure 3:
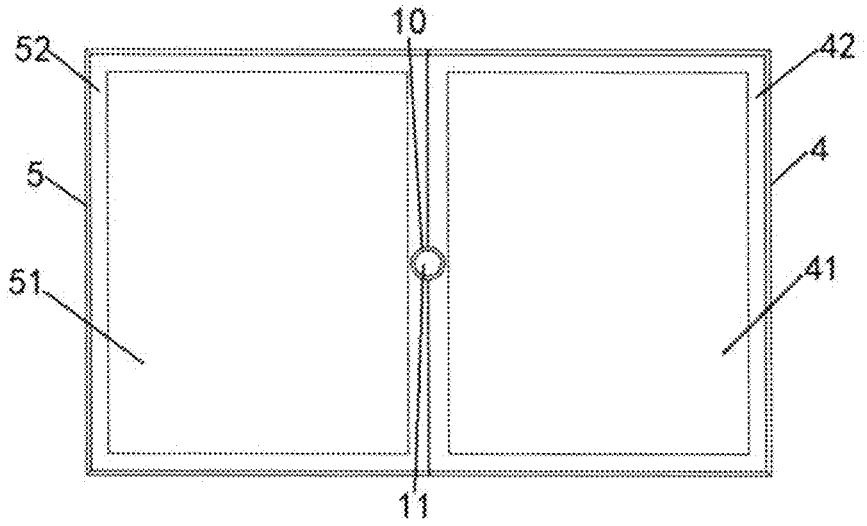
FIG. 3 is a top view of an easy-to-transport table.
Figure 4:
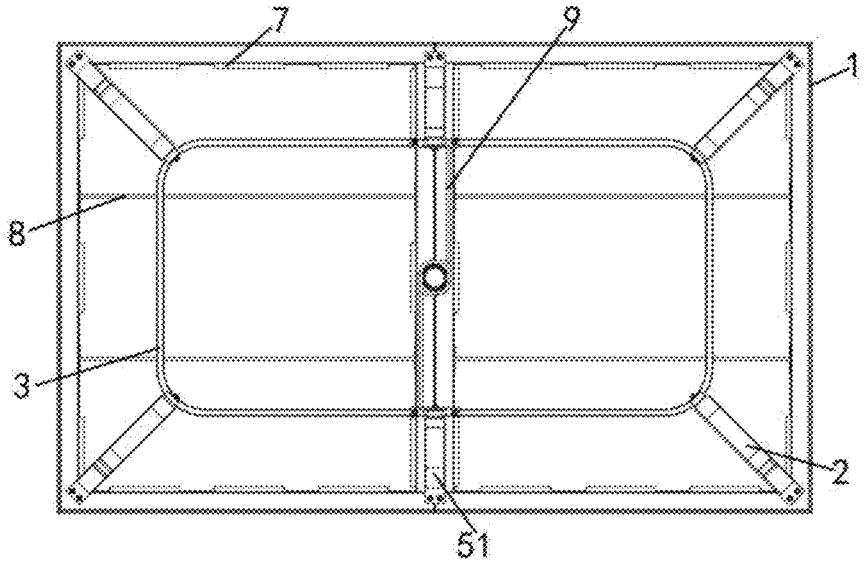
FIG. 4 is a bottom view of an easy-to-transport table.
Figure 5:
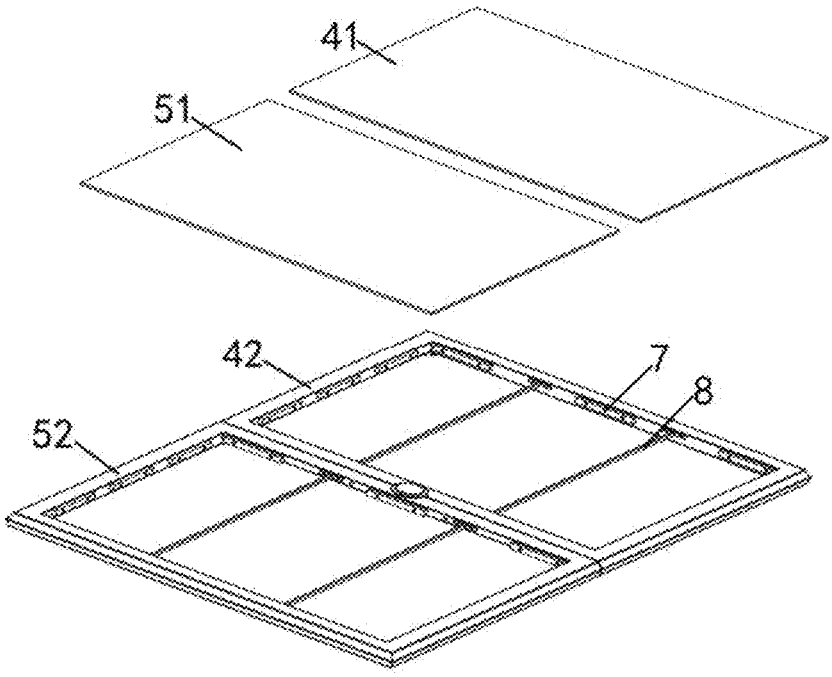
FIG. 5 is an exploded view of a table top in FIG. 1.
Figure 6:
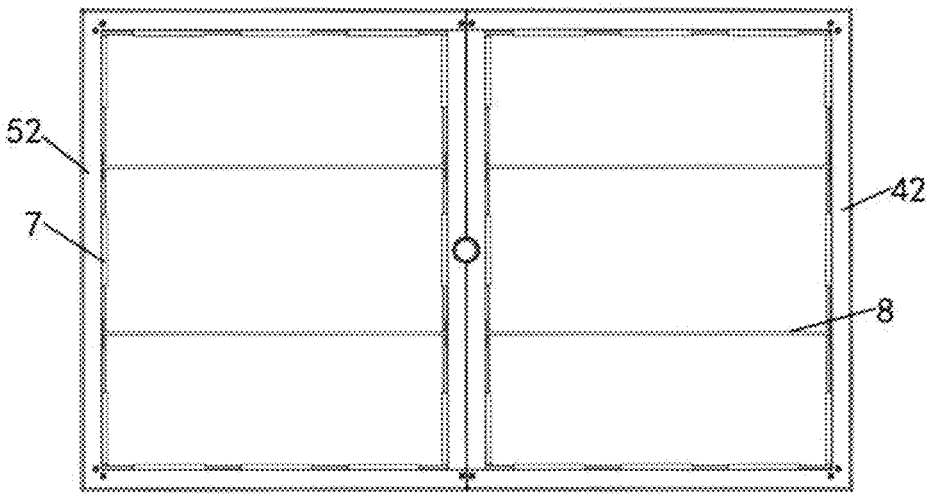
FIG. 6 is a bottom view of a first frame and a second frame in FIG. 1.
Figure 7:
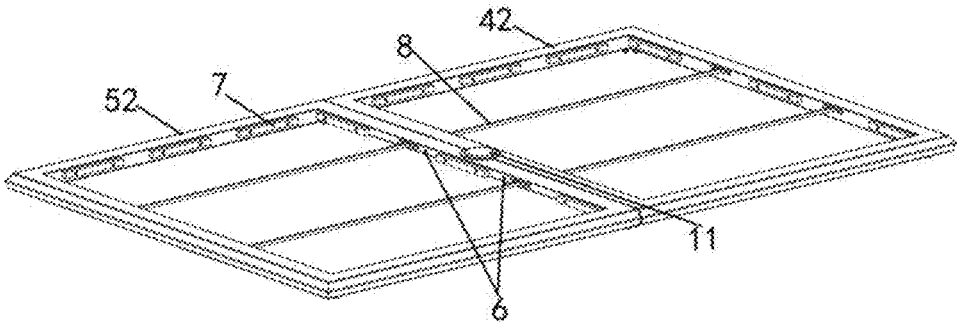
FIG. 7 is a schematic structural diagram of a first frame and a second frame in FIG. 1.
Figure 8:
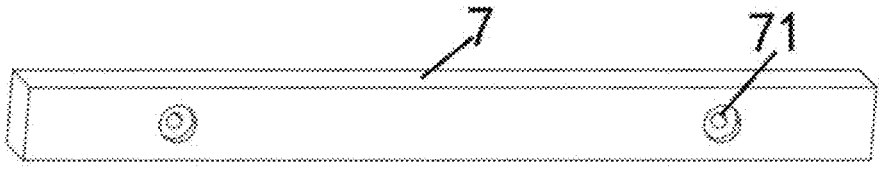
FIG. 8 is a schematic structural diagram of a square fixed strip in FIG. 1.
Figure 9:
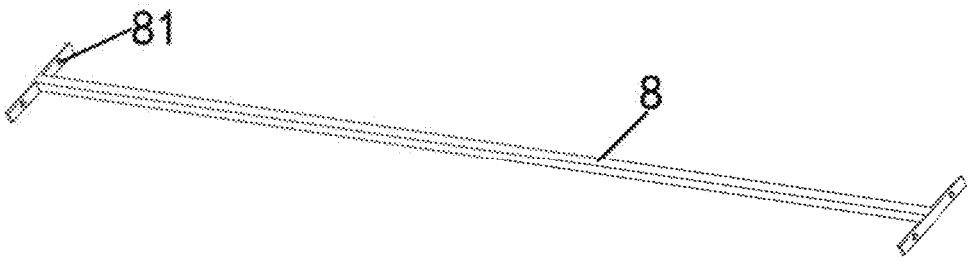
FIG. 9 is a schematic structural diagram of a support member in FIG. 1.
Figure 10:
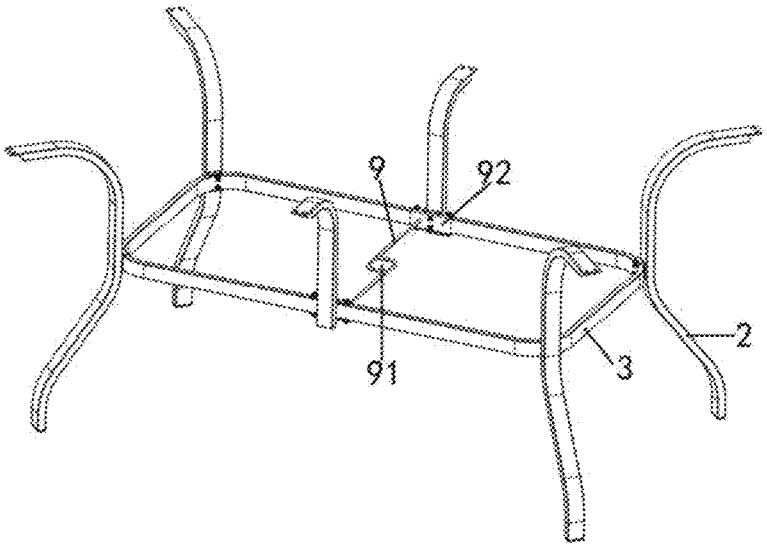
FIG. 10 is a schematic structural diagram of table legs, a support frame, and a bracket in FIG. 1.
Figure 11:
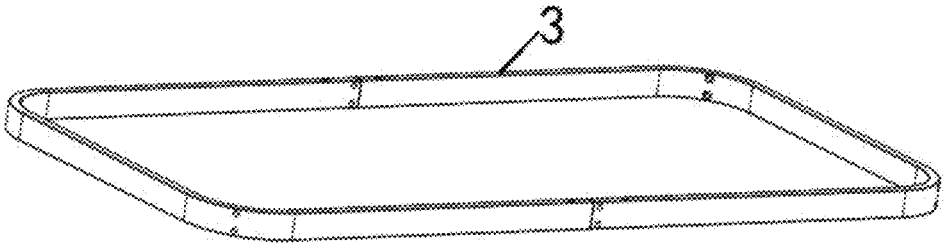
FIG. 11 is a schematic structural diagram of a support frame in FIG. 1.
Figure 12:
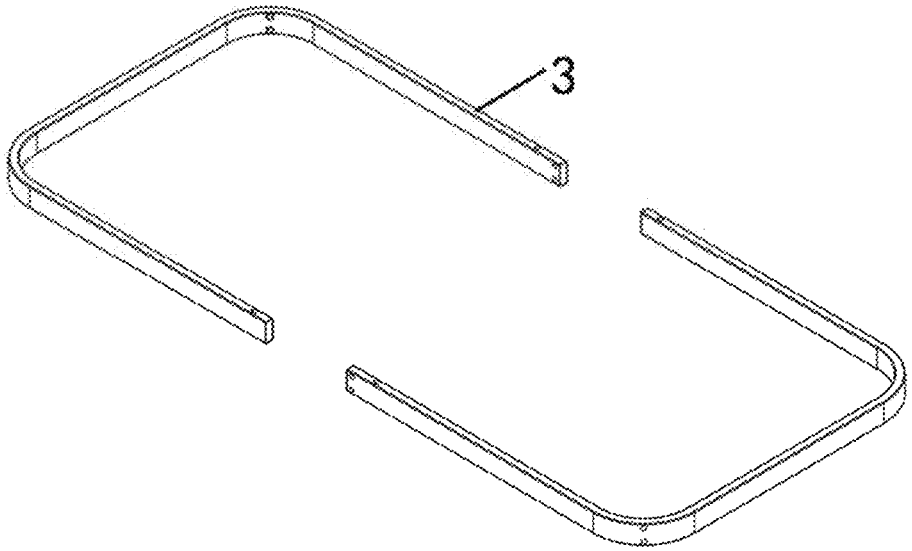
FIG. 12 is an exploded view of a support frame in FIG. 1.
Figure 13:
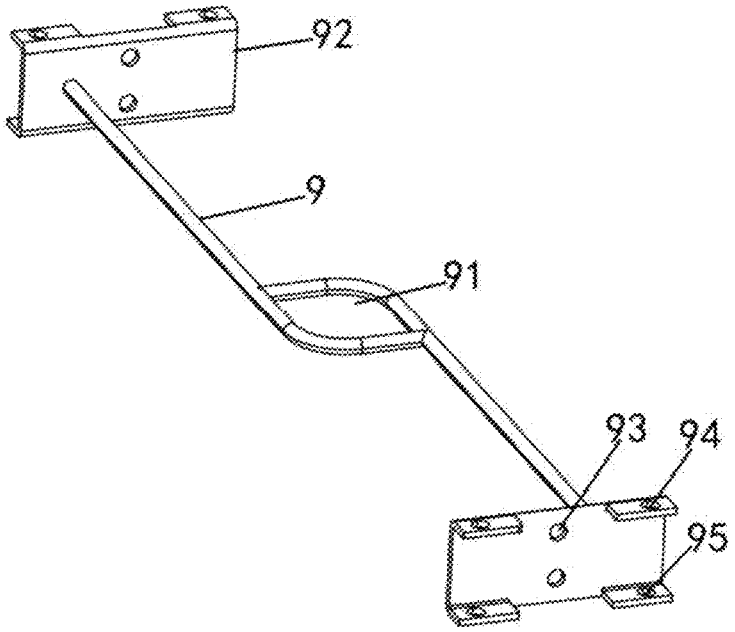
FIG. 13 is a schematic structural diagram of a bracket in FIG. 1.
Figure 14:
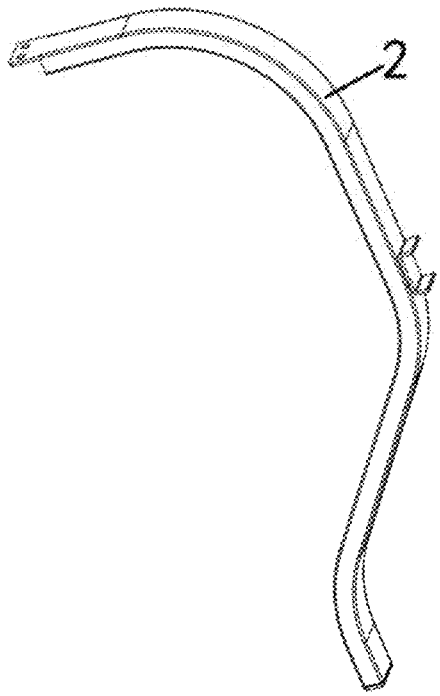
FIG. 14 is a schematic structural diagram of a table leg in FIG. 1.
Figure 15:
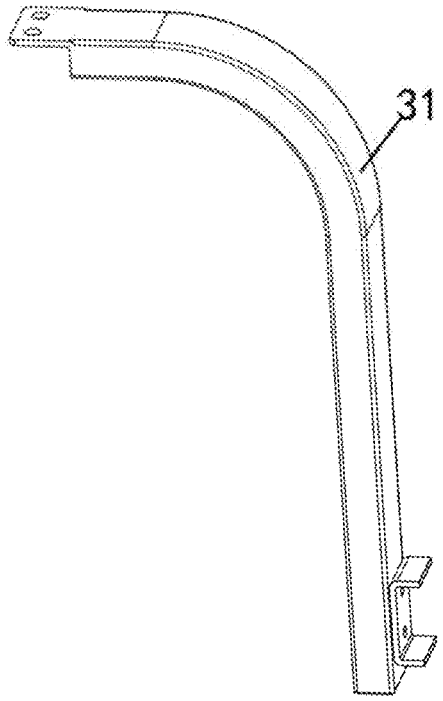
FIG. 15 is a schematic structural diagram of a support rod in FIG. 1.
Figure 16:
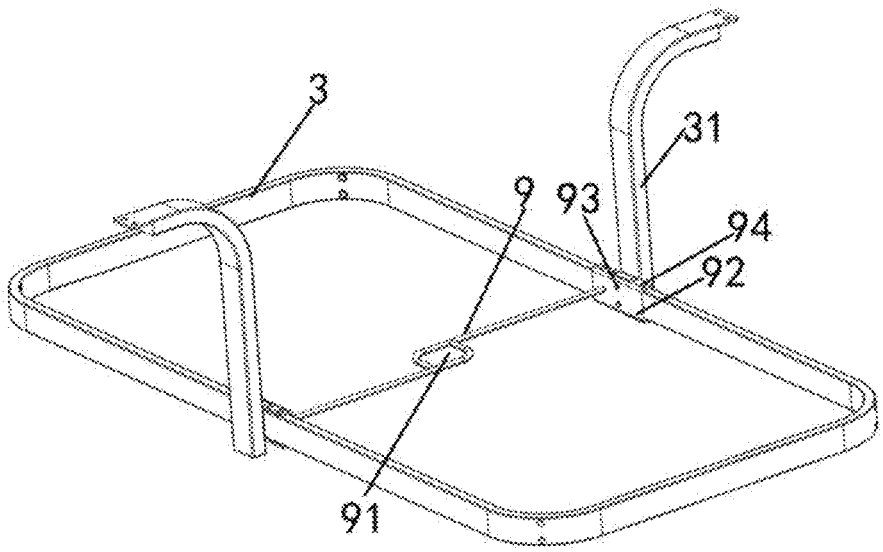
FIG. 16 is a schematic structural diagram of a bracket and a support rod in FIG. 1.
Figure 17:
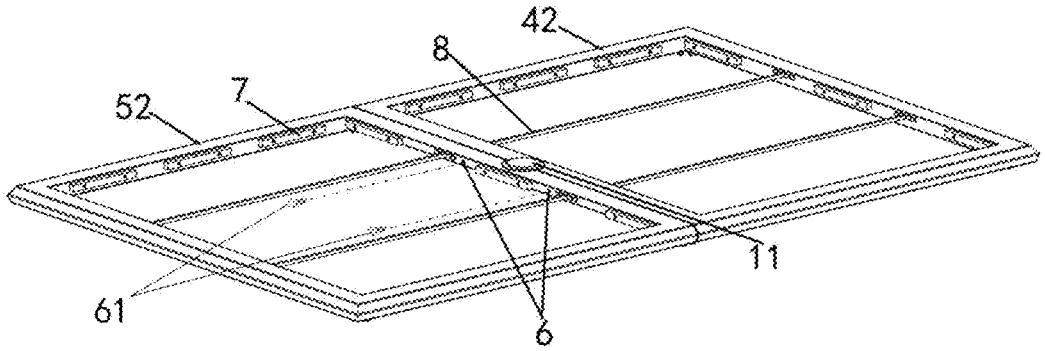
FIG. 17 is a schematic structural diagram of a first frame, a second frame and a bolt in FIG. 1.
Figure 18:
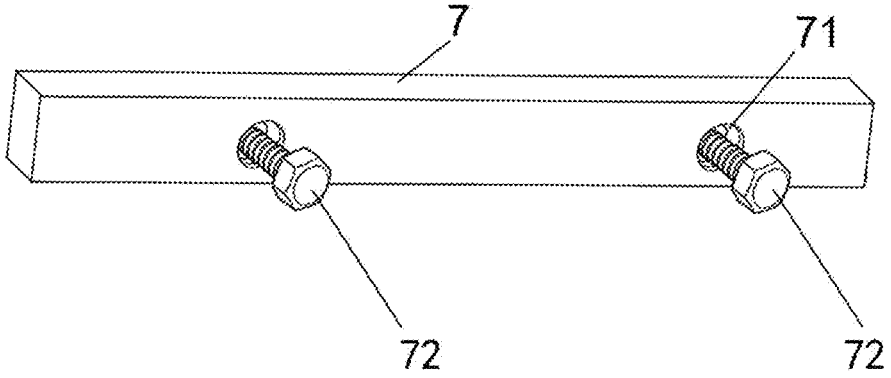
FIG. 18 is a schematic structural diagram of a square fixed strip, a mounting hole B and a bolt in FIG. 1.
Figure 19:
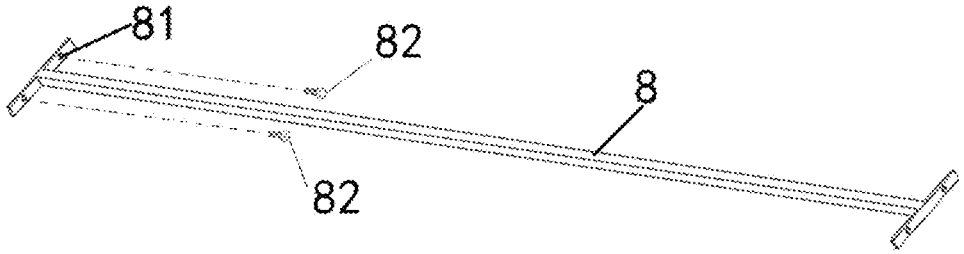
FIG. 19 is a schematic structural diagram of a support member, a mounting hole C and a bolt in FIG. 1.

As shown in FIG. 1 to FIG. 19, according to an easy-to-transport table provided by the embodiment, the table top 1 is formed by splicing a first table top 4 and a second table top 5 having the same shape, the first table top 4 includes a first table plate 41 arranged in a first frame 42, the second table top 5 includes a second table plate 51 arranged in a second frame 52, a penetrating mounting hole A 6 is arranged at a joint of the first frame 42 and the second frame 52, and a bolt 61 is arranged in the mounting hole A 6 for splicing and fixing the first frame 42 and the second frame 52. The bolt 61 in the mounting hole A 6 is used for mounting the first table top 4 and the second table top 5 together. When transportation is required, the first table top 4 and the second table top 5 can be separated by disassembling the bolt 61 in the mounting hole A 6 and two bolts at the other end of the support rod 31 fixed to the bottom surface of the first frame 42 and the second frame 52. After being separated, the first table top 4 and second table top 5 can be transported in a stacked manner, thereby reducing the transportation space.

In this embodiment, each side surface of inner sides of the first frame 42 and the second frame 52 is provided with a square fixed strip 7 in an abutting manner, each square fixed strip 7 is provided with two horizontally penetrating mounting holes B 71, bolts 72 are respectively arranged in each mounting hole B 71 to be in threaded connection with the first frame 42, and bolts 72 are respectively arranged in each mounting hole B 71 to be in threaded connection with the second frame 52. Inner side areas of the first frame 42 and the second frame 52 are each provided with a transverse support member 8 in an abutting manner, and the support members 8 are uniformly distributed at intervals in the inner side areas of the first frame 42 and the second frame 52. Two mounting holes C 81 are arranged at both ends of each support member 8, a bolt 82 is arranged in each mounting hole C 81 at one end of the support member 8 and is connected to the first frame 42, and a bolt 82 is arranged in each mounting hole C 81 at the other end of the support member 8 and is connected to the second frame 52. The square fixed strip 7 and the support member 8 are used for fixing the first table plate 41 in the first frame 42, and fixing the second table plate 51 in the second frame 52.

In this embodiment, four corners of a bottom surface of the table top 1 are in bolted connection with the table legs 2, two fixed holes are arranged at an edge of a top end of each table leg, and bolts in the fixed holes are in threaded connection with the table top 1. An enclosed area of inner sides of the table legs 2 is in bolted connection with the rectangular support frame 3, a middle position of each table leg 2 is connected to four corners of the support frame 3 through two bolts, respectively, and the support frame 3 is formed by splicing two U-shaped members with openings opposite to each other. A long-edge frame of a body of the support frame 3 is vertically provided with a support rod 31, and the top of the support rod 31 is connected to the bottom of the table top 1 through two bolts for improving stability of the table. An outer side of a middle position of the long-edge frame of the support frame 3 is in threaded connection with a side surface of one end of the support rod 31, and the other end of the support rod 31 is respectively connected to bottom surfaces of the first frame 42 and the second frame 52 through two bolts. The stability of the table legs 2 is reinforced by the support frame 3, and the stability between the support frame 3 and the table top 1 is reinforced by the support frame 3, so that the table is good in stability. A bracket 9 is arranged on an inner side of the middle of the support frame 3, connecting members 92 are arranged at two ends of the bracket 9, the connecting members 92 are clamped to the support frame 3, and an umbrella rod fixed square hole B 91 is arranged in the middle of the bracket 9 for fixing a sunshade. Two threaded holes A 93 arranged up and down are arranged at a side surface of each connecting member 92, and bolts in the threaded holes A 93 sequentially penetrate through the connecting members 92 and the support frame 3 to be in threaded connection with the support rod 31, so that the bracket 9, the support frame 3, and the support rod 31 are fixed. Two threaded holes B 94 are arranged at the top of each connecting member 92, two threaded holes C 95 are arranged at the bottom of each connecting member 92, and bolts in the threaded holes B 94 and the threaded holes C 95 are connected to the support frame 3 so that the two U-shaped members in the support frame 3 are fixed. A structure which is connected by a bolt is arranged between the table top 1 and the table legs 2, the table legs 2 and the support frame 3, the two U-shaped members in the support frame 3, and the support frame 3 and the support rod 31, respectively, which is convenient to disassemble and assemble. Each part is disassembled and then packaged and transported, thereby greatly reducing the transportation space and saving the transportation cost.

In this embodiment, the center of a joint of the first frame 42 and the second frame 52 is provided with an umbrella rod fixed circular hole A 10, the umbrella rod fixed square hole B 91 is arranged in the middle of the bracket 9, and centers of the umbrella rod fixed circular hole A 10 and the umbrella rod fixed square hole B 91 are aligned for jointly fixing the sunshade. A cover body 11 is arranged on the umbrella rod fixed circular hole A 10. When the sunshade is not needed, the cover body 11 is covered on the umbrella rod fixed circular hole A 10, and when the sunshade needs to be mounted, the umbrella rod of the sunshade is inserted into the umbrella rod fixed circular hole A 10 and the umbrella rod fixed square hole B 91, which increases the practicability of the table. In addition, the umbrella rod fixed circular hole A 10 and the umbrella rod fixed square hole B 91 jointly fix the umbrella rod of the sunshade, which increases the stability of the sunshade.

Embodiment 2

As shown in FIG. 2, and FIG. 10 to FIG. 16, the table top 1 is an integral body, a body of the table top 1 includes a table top, and an outer frame (not shown in the figure) is arranged on the periphery of the table plate. Four corners of a bottom surface of the table top 1 are located at the outer frame arranged on the periphery of the body of the table top 1, and are in bolted connection with the table legs 2. An enclosed area of inner sides of the table legs 2 is in bolted connection with the rectangular support frame 3, a long-edge frame of a body of the support frame 3 is vertically provided with a support rod 31, and the top of the support rod 31 is in bolted connection with the bottom of the table top 1 for improving stability of the table.

The four corners of the bottom surface of the table top 1 are located at the outer frame arranged on the periphery of the body of the table top 1, and are in bolted connection with the table legs 2. Two fixed holes are arranged at an edge of a top end of each table leg, and bolts in the fixed holes are in threaded connection with the outer frame of the table top 1. An enclosed area of inner sides of the table legs 2 is in bolted connection with the rectangular support frame 3, a middle position of each table leg 2 is connected to four corners of the support frame 3 through two bolts, respectively, and the support frame 3 is formed by splicing two U-shaped members with openings opposite to each other. A long-edge frame of a body of the support frame 3 is vertically provided with a support rod 31, and the top of the support rod 31 is connected to the bottom of the outer frame of the table top 1 through two bolts for improving stability of the table. An outer side of a middle position of the long-edge frame of the support frame 3 is in threaded connection with a side surface of one end of the support rod 31, and the other end of the support rod 31 is respectively connected to a bottom surface of the outer frame arranged on the periphery of the body of the table top 1 through two bolts. The stability of the table legs 2 is reinforced by the support frame 3, and the stability between the support frame 3 and the table top 1 is reinforced by the support frame 3, so that the table is good in stability. A bracket 9 is arranged on an inner side of the middle of the support frame 3, connecting members 92 are arranged at two ends of the bracket 9, the connecting members 92 are clamped to the support frame 3, and an umbrella rod fixed square hole B 91 is arranged in the middle of the bracket 9 for fixing a sunshade.

Two threaded holes A 93 arranged up and down are arranged at a side surface of each connecting member 92, and bolts in the threaded holes A 93 sequentially penetrate through the connecting members 92 and the support frame 3 to be in threaded connection with the support rod 31, so that the bracket 9, the support frame 3, and the support rod 31 are fixed. Two threaded holes B 94 are arranged at the top of each connecting member 92, two threaded holes C 95 are arranged at the bottom of each connecting member 92, and bolts in the threaded holes B 94 and the threaded holes C 95 are connected to the support frame 3, so that the two U-shaped members in the support frame 3 are fixed. A structure which is connected by a bolt is arranged between the table top 1 and the table legs 2, the table legs 2 and the support frame 3, the two U-shaped members in the support frame 3, and the support frame 3 and the support rod 31, respectively, which is convenient to disassemble and assemble. Each part is disassembled and then packaged and transported, thereby greatly reducing the transportation space and saving the transportation cost.

In this embodiment, the center of the table top 1 is provided with an umbrella rod fixed circular hole A 10, the umbrella rod fixed square hole B 91 is arranged in the middle of the bracket 9, and centers of the umbrella rod fixed circular hole A 10 and the umbrella rod fixed square hole B 91 are aligned for jointly fixing the sunshade. A cover body 11 is arranged on the umbrella rod fixed circular hole A 10. When the sunshade is not needed, the cover body 11 is covered on the umbrella rod fixed circular hole A 10, and when the sunshade needs to be mounted, the umbrella rod of the sunshade is inserted into the umbrella rod fixed circular hole A 10 and the umbrella rod fixed square hole B 91, which increases the practicability of the table. In addition, the umbrella rod fixed circular hole A 10 and the umbrella rod fixed square hole B 91 jointly fix the umbrella rod of the sunshade, which increases the stability of the sunshade.

Finally, it should be noted that the above embodiments are only used to illustrate the technical solution of the present invention rather than limiting thereto. Although the present invention has been described in detail with reference to the foregoing embodiments, those of ordinary skill in the art should understand that the technical solution recited in the foregoing embodiments may still be modified, or some or all of the technical features thereof may be replaced with equivalents. These modifications or replacements do not make the essence of the corresponding technical solution deviate from the scope of the technical solution in the embodiments of the present invention.

What is claimed is:

1. An easy-to-transport table, comprising a table top (1), wherein four corners of a bottom surface of the table top (1) are in bolted connection with table legs (2), an enclosed area of inner sides of the table legs (2) is in bolted connection with a rectangular support frame (3), a long-edge frame of a body of the support frame (3) is vertically provided with a support rod (31), and the top of the support rod (31) is in bolted connection with the bottom of the table top (1) for improving stability of the table;

wherein a bracket (9) is mounted in the support frame (3), connecting members (92) are arranged at two ends of the bracket (9), the connecting members (92) are clamped to the support frame (3);

and wherein two threaded holes A (93) arranged up and down are arranged at a side surface of each connecting member (92), bolts in the threaded holes A (93) sequentially penetrate through the connecting members (92) and the support frame (3) to be in threaded connection with the support rod (31); two threaded holes B (94) are arranged at the top of each connecting member (92), two threaded holes C (95) are arranged at the bottom of each connecting member (92), and bolts in the threaded holes B (94) and the threaded holes C (95) are connected to the support frame (3).

2. The easy-to-transport table according to claim 1, wherein the table top (1) is formed by splicing a first table top (4) and a second table top (5) having the same shape, the first table top (4) comprises a first table plate (41) arranged in a first frame (42), the second table top (5) comprises a second table plate (51) arranged in a second frame (52), a penetrating mounting hole A (6) is arranged at a joint of the first frame (42) and the second frame (52), and a bolt (61) is arranged in the mounting hole A (6) for splicing and fixing the first frame (42) and the second frame (52).

3. The easy-to-transport table according to claim 2, wherein each side surface of inner sides of the first frame (42) and the second frame (52) is provided with a square fixed strip (7) in an abutting manner against inner side surfaces of the first frame (42) and the second frame (52), inner side areas of the first frame (42) and the second frame (52) are each provided with a transverse support member (8) in an abutting manner against inner side surfaces of the first frame (42) and the second frame (52), and the support members (8) are uniformly distributed at intervals in the inner side areas of the first frame (42) and the second frame (52).

4. The easy-to-transport table according to claim 3, wherein a horizontal penetrating mounting hole B (71) is arranged on the square fixed strip (7), and a bolt (72) is arranged in the mounting hole B (71) to be in threaded connection with the first frame (42); two mounting holes C (81) are arranged at both ends of each support member (8), and a bolt (82) is arranged in each mounting hole C (81) to be in threaded connection with the first frame (42).

5. The easy-to-transport table according to claim 1, wherein four corners of the support frame (3) are in bolted connection with the table legs (2), and the support frame (3) is formed by splicing two U-shaped members with openings opposite to each other.

6. The easy-to-transport table according to claim 2, wherein an outer side of the long-edge frame of the body of the support frame (3) is in threaded connection with a side surface of one end of the support rod (31), and a top surface of the other end of the support rod (31) is connected to bottom surfaces of the first frame (42) and the second frame (52).

7. The easy-to-transport table according to claim 1, wherein an umbrella rod fixed square hole B (91) is arranged in the middle of the bracket (9) for fixing a sunshade.

8. The easy-to-transport table according to claim 2, wherein the center of a joint of the first frame (42) and the second frame (52) is provided with an umbrella rod fixed circular hole A (10), centers of the umbrella rod fixed circular hole A (10) and the umbrella rod fixed square hole B (91) are aligned for jointly fixing the sunshade, and a cover body (11) is arranged on the umbrella rod fixed circular hole A (10).

* * * * *